United States Patent [19]

Bezsilko

[11] 4,088,143

[45] May 9, 1978

[54] APPARATUS FOR FEEDING AND ORIENTING COINS

[75] Inventor: Nicolas Bezsilko, Tourcoing, France

[73] Assignee: S.A. Vandeputte Fils & Cie, Tourcoing, France

[21] Appl. No.: 694,021

[22] Filed: Jun. 7, 1976

[30] Foreign Application Priority Data

Jul. 2, 1975 France ..... 75 21316

[51] Int. Cl.[2] ..... G07D 9/00

[52] U.S. Cl. ..... 133/1 R; 133/3 A

[58] Field of Search ..... 133/1 R, 3 R, 3 A, 3 E, 133/8 R, 8 B, 8 C, 8 SR; 209/87, 104, 105, 96, 90; 221/167, 168, 159–162, 277, 7; 198/392, 396

[56] References Cited

U.S. PATENT DOCUMENTS

| | | | |
|---|---|---|---|
| 2,137,501 | 11/1938 | Myers | 133/8 R |
| 2,155,982 | 4/1939 | Seemel | 133/8 R |
| 2,725,971 | 12/1955 | Clark-Riede, Jr. | 221/159 |

FOREIGN PATENT DOCUMENTS

| | | | |
|---|---|---|---|
| 2,519,424 | 11/1975 | Germany | 133/3 R |

*Primary Examiner*—Robert B. Reeves
*Assistant Examiner*—H. Grant Skaggs
*Attorney, Agent, or Firm*—Cameron, Kerkam, Sutton, Stowell & Stowell

[57] ABSTRACT

A device for sorting and separating coins has a track with an increasing width between the feed point for the coins and the exit point for the coins.

6 Claims, 3 Drawing Figures

APPARATUS FOR FEEDING AND ORIENTING COINS

BACKGROUND OF THE INVENTION

The present invention deals with a separating and sorting coin money device, as well as with sorting machines which may also count the coins. These machines have the following essential characteristics:

(1) A separating and sorting device for coin money drawn from a pile of coins to be sorted.

(2) A coin shifting device for the thus separated and sorted coins towards the next station with a speed increase for the coins.

(3) A coin sorting and removing device which usually brings the coins to distinct receptacles according to each coin type.

A rotating turntable is known and used for coin separation and sorting which provides a circular track having an outer fixed crown on which the coins rest and roll.

At a specific point of the crown, the so-called "exit-point", there is a notch which enables the coins to be ejected to the next operating station since they no longer have a point of support.

It has been noted that with a turntable such as this, when two coins move more or less together on the track they are both ejected, thus interrupting the strict alignment necessary for an accurate count.

To prevent this, instead of a turntable, it is known to use a dish where the circular track is formed by a lateral wall area and as such is limited from without by the fixed crown or rim and from within by the cavity of the dish.

Any excess number of coins can then fall in the dish before being taken by transfer means to bring the coins individually onto the track at a determined point, called the transfer point.

In other known mechanisms, the fixed crown is concentric with the dish and as a result, the track width is constant at all points, such as the transfer and exit points.

Given the differences between coin diameters to be sorted, the dish mechanism cannot, unfortunately, prevent very small coins progressing side by side from dropping into the dish if the biggest coins are to have a very good seating prior to their passage to the exit point.

To counter this inconvenience, a ramp upstream of the exit point has been used with a starting point tangentially connected to the internal side of the fixed crown, which in turn remains concentric with the track.

This ramp provides a limit for the track such that its width, without being below half the diameter of the biggest coins to be sorted, also is not more than one and a half times the diameter of the smallest coins to be sorted.

This construction is interesting in that the failure to stabilize large diameter coins is thus limited to a small part of the track which is, unfortunately, located near the exit point where the coins should be perfectly placed in order since this is the essential object of the separating and sorting device.

Aside from the disorder it creates in coin sorting, this ramp represents an additional device to be made and attached to the device, which increases costs.

Moreover, in each of these solutions, coins with large diameters with a large overhang over the dish can be struck by coins set in motion by the transfer means and therefore can also be disturbed.

In the separation and sorting devices with a dish, the fixed crown is always concentric; on the other hand, in turntable devices, it is known to place the fixed crown in a somewhat eccentric manner, to give the part of the crown in use a spiral shape in order to gradually guide the coins to another track and/or accelerate their speed.

This does not modify the width of the track in any way since this track is not inwardly limited.

SUMMARY OF THE PRESENT INVENTION

One of the objects of the present invention is a sorting and/or counting machine or a device for separation and sorting of coins which includes the above-mentioned dish, while removing excess small coins, provides large size coins with a good seating without exposing them to engagement by the loose coins in the dish, especially when they are ready to leave the fixed crown.

Another object of the present invention is a device which assures the removal of excess small coins without the use of additional structure mounted on the device.

To this end, the present invention is characterized in that from a point near the transfer point up to the exit point, the track increases in width in the following manner:

(1) The width near the transfer point, is not less than half the diameter of the biggest coin to be sorted and is less than one and a half times the diameter of the smallest coin.

(2) On the other hand, the width near the exit point must be sufficient to provide a complete support for the biggest coin to be sorted.

DESCRIPTION OF THE ACCOMPANYING DRAWINGS

The invention will be clearly understood with the help of the following explanation of a non-limiting but preferred embodiment shown in the accompanying drawing in which.

DESCRIPTION OF THE PREFERRED EMBODIMENT

Figure 1:
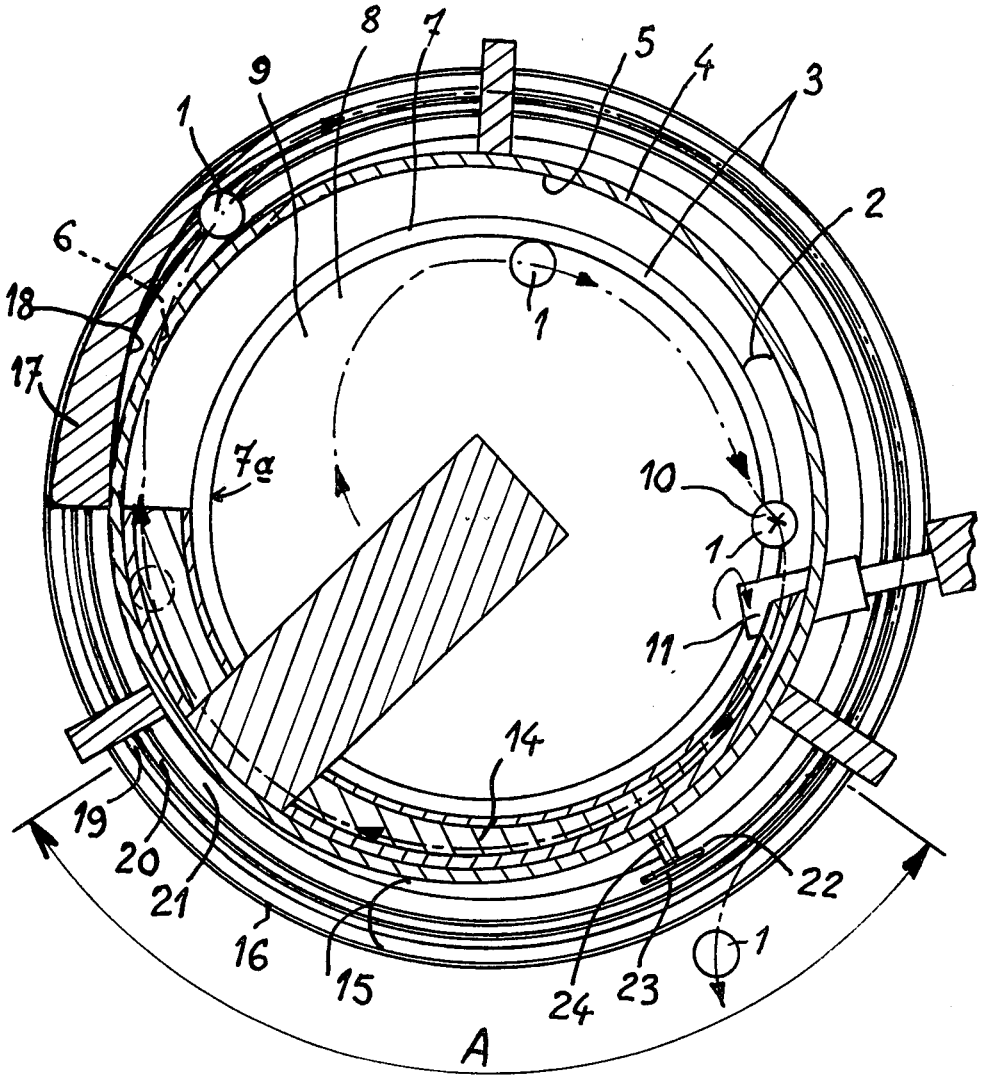
FIG. 1 is a top view of a money sorting device in which the fixed parts of the machine have been cross-hatched.
Figure 2:
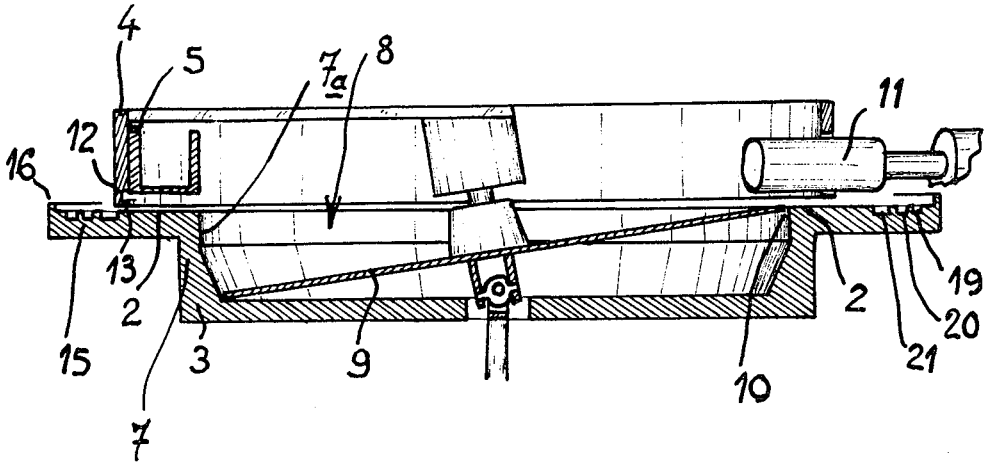
FIG. 2 is an axial view of the embodiment of FIG. 1.
Figure 3:
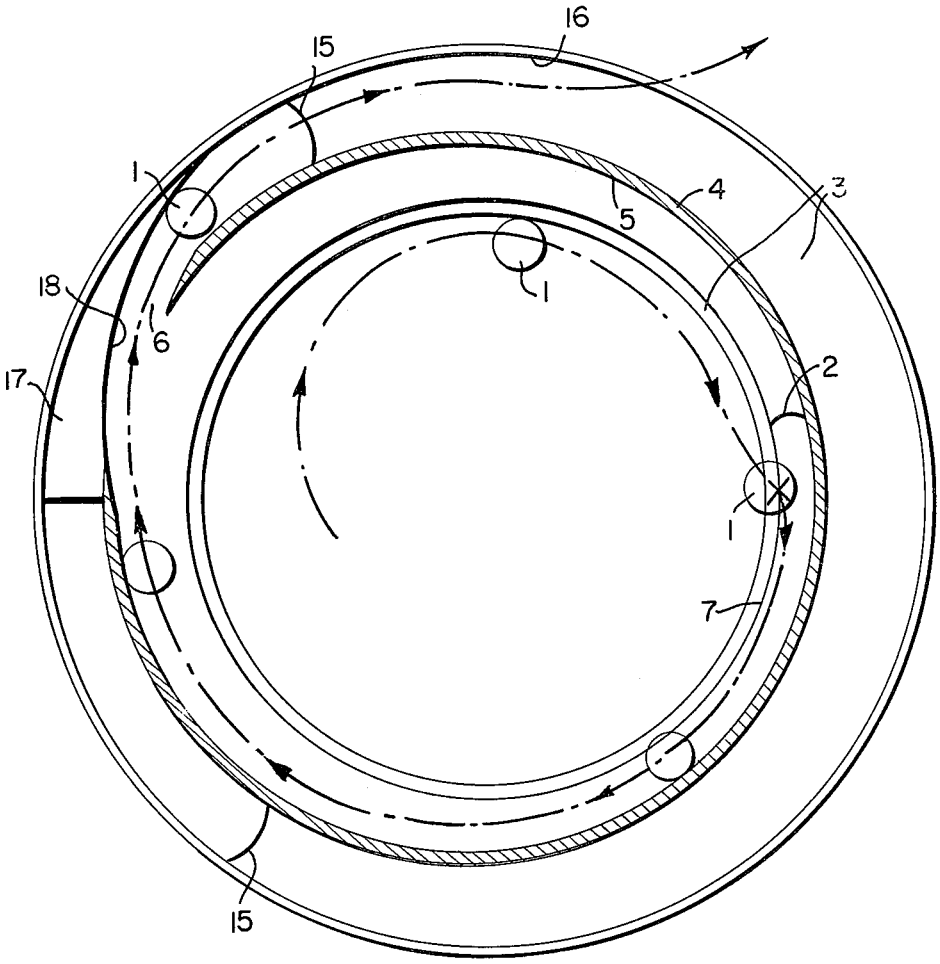
FIG. 3 is a cross-sectional view of the crown.

The device of FIGS. 1 and 2 for the separation and sorting of coins has a circular track carried by a rotating dish 3 set in a rotary motion by known means. This track is defined by an outer fixed crown or rim 4.

Coins 1, resting flat on circular track 2 are moved by the centrifugal force generated by the rotation of member 3, and roll and/or slide on the internal side 5 of fixed crown or rim 4.

At a determined point on crown 4, the so called "exit point", there is a notch 6 whereby coins 1 that no longer engage side 5 are moved to the next station. Circular track 2 is made up of members 3 and lateral wall area 7 in a dish like form 8 where, in its central cavity, the coins to be sorted are fed. Central cavity 8 houses a rotary table 9 which occupies most of said cavity. Table 9 provides means for transferring coins onto track 2 and is moved by any known means in rotary motion relative to the dish in such a way that the loose coins resting flat on table 9, with the help of centrifugal force, will find support and will roll and/or slide on the internal side 7a of the lateral wall 7 up to a point 10, the so called "transfer point", where these coins will move towards circular track 2.

To obtain this movement, table 9 is slightly inclined from the horizontal in order that point 10 on its periphery is substantially at the same level as circular track 2. Thus, the coins located at the periphery of table 9 will lose their support on the internal side 7a of the lateral wall 7 and will be thrust onto circular track 2.

The circumferential speed of the track is higher than that of the table and the coins have an adequate spacing by the passage from the table to the track.

Adjustment of the width and height of notch 6 is not sufficient for the accurate separation of coins having a large diameter or a thickness which at most is equal to half the size of the most important coins to be sorted which coins could thus go through the notch side by side or on top of each other. Therefore, to avoid a resulting counting error, circular track 2 has means for insuring this separation.

To overcome coin superposition, a counter roller 11 rotates above circular track 2 to push excess coins away. Moreover, slightly upstream of notch 6 a groove 12 is provided starting from internal side 5 of the fixed crown or rim 4 forming with it a large angle and extending at a height such that at the base of the fixed crown there is a flange 13 which, in relation to the track, has an upper side equal at most to the thickness of the smallest coin to be sorted.

Thus, only the coins which have a direct track support are supported by the flange while the coins above these must roll down on groove 12 and, when passing on the ramp, would be moved back towards the center of the crown and could not, as a result, leave through the notch.

Sector 14 is provided, not to avoid superposition of coins since that is dealt with as above, but to avoid either a direct opening on circular track 2 or the displacement of coins moving on this track between the transfer point 10 and the exit point 6 by coins resting on the table. Sector 14 covers an area of the track and is fastened to crown 4 high enough above the track to let the thickest coins through without striking one another.

To prevent side by side arrangement, the width of track 2 is limited at least locally, in order for a single coin to find a stable support, while the other coins, by gravity, will fall into the cavity of the dish.

According to a principal characteristic of the present invention, the limit of the width of the track is determined, without use of a ramp which could disturb the coins, by a simple offsetting of the entire fixed crown or rim 4 in relation to the dish.

According to another characteristic of the present invention, this offset is such that the lower limit of the width of track 2 occurs slightly beyond transfer point 10 or at the most up stream point above the exit point in order that at the exit point the track is wide enough to provide a complete support for the biggest coin and no part of it will there hang over cavity 8 of the dish.

In order to prevent other coins from coming onto the track and interfering with the progress of those advancing between the point where a width limitation occurs and the exit point, this area of track 2 is advantageously covered by sector 14 under which the coins completely disappear. The maximum limitation of the track occurs slightly beyond transfer point 10 where the coins are more easily placed.

This device including the off-centered crown or rim 4, the counter roller 11 and groove 12 thus provides a feed regulated in height and width.

For sorting after leaving crown 14, it is known to place the coins on a turn table with a sorting and ejection track 15.

It is advantageous to have member 3 providing the circular track 2 continue on to the periphery of fixed crown 4, with a value at least equal to the diameter of the biggest coin to be sorted in order to reserve around the fixed crown, within the plane of circular track 2, the above-mentioned sorting and ejection track 15.

This track is defined from without by a circular lip 16, on which, by centrifugal force, the coins leaving the crown find support.

The difference of radius between circular track 2 and track 15 causes an acceleration and an increased spacing of the coins. In order to decrease the suddeness of this change, a fixed guide 17 with a ramp 18 progressively move the coins up to lip 16.

Track 15 and circular track 2 being on the same member 3, a coin should never slide flat on an intermediate coin which would be stationary to pass from track 2 to track 15. As a result, its speed is not decreased.

Moreover, the same rotary drive as well as the same guiding methods are used to move circular track 2 and track 15 since they are rotated together.

Also, track 15 is concentric to track 2. Therefore the machine is half the size of traditional machines where the sorting turntable is placed beside the track.

The top of track 15 has at least one circular groove 19 located at such a distance from lip 16 that the coins supported in one area against the lip, have their diametrically opposed area overhanging groove 19.

At least another slot can be used when the coins to be sorted have large differences of diameter.

In these grooves, the front tips 22 of ejector fingers 23, extend. Only one of these is seen in FIG. 1 in order to simplify the drawings. These fingers of course, are in number equal to the number of diameters of the coins to be sorted. These fingers are located in a large zone A.

The height of front tip 22 of a finger is such that the top of the tip is at a lower level than the top of the track in order for it to slip freely under a coin having a diameter corresponding to the distance between the tip and lip 16.

The position of the finger is regulated in such a way that it engages coins 1 at their point diammetrically opposite to that bearing on lip 16. The passage of coins of smaller diameters than the ones the finger must eject must not be obstructed between lip 16 and the side of the finger toward the lip.

Finger 23 is secured to the fixed part by a support 24 which passes above the track. This support is provided with known adjustment means for adjustment in a radial direction.

The rear part of finger 23 has an increasing height to form a ramp which progressively lifts the edge of the coin drawn toward the back of the finger by the rotation of the track.

Because of the kinetic energy the coins have stored during their rotation on track 15, after a certain lifting the coins are projected toward receptacles located around the track adjacent each ejection finger.

What I claim is:

1. Apparatus for feeding and orienting pieces of money, coins and similar objects in a sorting machine comprising; a rotating dish, an axis of rotation for said dish, an upper face for said dish, a cavity at the center of said dish containing the pieces to be fed and oriented, a peripherable wall for said cavity inwardly of said upper face, means for bringing the pieces to be oriented flat on said upper face of said dish at a transfer point, a fixed crown disposed above said upper face of said dish, an internal face for said crown against which the pieces engage by centrifugal force resulting from rotation of said dish, a circular path formed by a part of said upper surface of said dish between said peripherable wall of said cavity and the internal face of said crown, a passage in said crown situated downstream of said transfer point at an exit point so that the pieces which no longer bear against said face of said crown are ejected to a following operating position, the improvement comprising said track having an increasing width beginning in an area near said transfer point up to said passage such that adjacent said transfer point said width is less than one-half of the diameter of the largest of the pieces to be oriented and is not greater than one and a half times the diameter of the smallest of the pieces and adjacent said passage said width is sufficient to provide total support for the largest of said pieces to be oriented.

2. A device according to claim 1 including a flange fixed with respect to said crown above said track extending from adjacent said passage upstream to said transfer point and spaced above said track for the passage of the thickest coin to be sorted whereby striking of the coins is prevented.

3. A device according to claim 1, said track having its narrowest width located upstream from said exit point and at least slightly downstream of said transfer point to facilitate the placing of the coins.

4. A device according to claim 1, including a counter-roller above said track and slightly downstream of said transfer point rejecting superimposed coins.

5. A device according to claim 1, said means for transferring coins including a rotary table forming a bottom for said dish said bottom being slightly sloped whereby only one point on the periphery of said bottom reaches the level of said circular track.

6. Apparatus for feeding and orienting pieces of money, coins and similar objects in a sorting machine comprising; a rotating dish, an axis of rotation for said dish, an upper face for said dish, a cavity at the center of said dish containing the pieces to be fed and oriented, a peripherable wall for said cavity inwardly of said upper face, means for bringing the pieces to be oriented flat on said upper face of said dish at a transfer point, a fixed crown disposed above said upper face of said dish, an internal face for said crown against which the pieces engage by centrifugal force resulting from rotation of said dish, a circular path formed by a part of said upper surface of said dish between said peripherable wall of said cavity and the internal face of said crown, a passage in said crown situated downstream of said transfer point at an exit point so that the pieces which no longer bear against said face of said crown are ejected to a following operating position, the improvement comprising said track having an increasing width beginning in an area near said transfer point up to said passage such that adjacent said transfer point said width is less than one-half of the diameter of the largest of the pieces to be oriented and is not greater than one and a half times the diameter of the smallest of the pieces and adjacent said passage said width is sufficient to provide total support for the largest of said pieces to be oriented, said crown being eccentric to said axis of rotation to provide said increasing width for said track.

* * * * *